US007677508B1

(12) United States Patent
Owens

(10) Patent No.: US 7,677,508 B1
(45) Date of Patent: Mar. 16, 2010

(54) EASY SWEEP TRASH BAG HOLDER

(76) Inventor: Anthony Owens, 295 Hoxie Ave., Calumet City, IL (US) 60409

( * ) Notice: Subject to any disclaimer, the term of this patent is extended or adjusted under 35 U.S.C. 154(b) by 0 days.

(21) Appl. No.: 11/112,703

(22) Filed: Apr. 24, 2005

Related U.S. Application Data

(60) Provisional application No. 60/568,361, filed on May 5, 2004.

(51) Int. Cl.
*B65B 67/04* (2006.01)

(52) U.S. Cl. ..... 248/101; 248/99

(58) Field of Classification Search ..... 248/98–101, 248/95, 166; 294/1.1, 1.3–1.5, 55; 15/257.1; 141/108, 316, 390, 391; D34/6; 220/9.2; 37/365

See application file for complete search history.

(56) References Cited

U.S. PATENT DOCUMENTS

| | | | | | |
|---|---|---|---|---|---|
| 3,475,838 | A | * | 11/1969 | Hagen et al. | 37/265 |
| 3,655,157 | A | * | 4/1972 | Dalton | 248/97 |
| 4,253,257 | A | * | 3/1981 | Albert | 37/197 |
| 5,581,915 | A | * | 12/1996 | Lobato | 37/285 |
| 6,003,820 | A | | 12/1999 | Baldonado | |
| 6,155,522 | A | | 12/2000 | Anderson | |
| 6,431,503 | B1 | | 8/2002 | Horan | |

* cited by examiner

*Primary Examiner*—Gwendolyn Baxter

(57) ABSTRACT

A bag holder combined with a trash bag for easy pickup and removal of leaves on a ground surface. The bag holder is a self-standing frame that has two adjustable legs to allow the bag holder to stand upward by itself. An attached clip holds a garbage in place in an open position so that leaves may easily be swept or blown into the bag.

4 Claims, 2 Drawing Sheets

EASY SWEEP TRASH BAG HOLDER

I. CROSS-REFERENCE TO RELATED APPLICATIONS

This application claims the benefit of U.S. Provisional Application No. 60/568,361, filed May 5, 2004.

II. BACKGROUND OF THE INVENTION

The present invention concerns that of a bag holder combined with a trash bag for easy pickup and removal of leaves on a ground surface.

III. DESCRIPTION OF THE PRIOR ART

U.S. Pat. No. 6,003,820, issued to Baldonado, discloses a flat rectangular debris directing device suited to hold a plastic bag in an open position.

U.S. Pat. No. 6,155,522, issued to Anderson, discloses a yard debris collecting assembly comprised of a chute attached to a bag.

U.S. Pat. No. 6,431,503, issued to Horan, discloses a device for holding a lawn bag holder in an open position comprised of a ramp for sweeping debris inside.

IV. SUMMARY OF THE INVENTION

The present invention concerns that of a bag holder combined with a trash bag for easy pickup and removal of leaves on a ground surface. The bag holder is a self-standing frame that has two adjustable legs to allow the bag holder to stand upward by itself. An attached clip holds a garbage in place in an open position so that leaves may easily be swept or blown into the bag.

There has thus been outlined, rather broadly, the more important features of a bag holder for pickup and removal of leaves that the detailed description thereof that follows may be better understood and in order that the present contribution to the art may be better appreciated. There are, of course, additional features of the bag holder for pickup and removal of leaves that will be described hereinafter and which will form the subject matter of the claims appended hereto.

In this respect, before explaining at least one embodiment of the bag holder for pickup and removal of leaves in detail, it is to be understood that the bag holder for pickup and removal of leaves is not limited in its application to the details of construction and to the arrangements of the components set forth in the following description or illustrated in the drawings. The bag holder for pickup and removal of leaves is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present bag holder for pickup and removal of leaves. It is important, therefore, that the claims be regarded as including such equivalent constructions insofar as they do not depart from the spirit and scope of the present invention.

It is therefore an object of the present invention to provide a bag holder for pickup and removal of leaves which has all of the advantages of the prior art and none of the disadvantages.

It is another object of the present invention to provide a bag holder for pickup and removal of leaves which may be easily and efficiently manufactured and marketed.

It is another object of the present invention to provide a bag holder for pickup and removal of leaves which is of durable and reliable construction.

It is yet another object of the present invention to provide a bag holder for pickup and removal of leaves which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
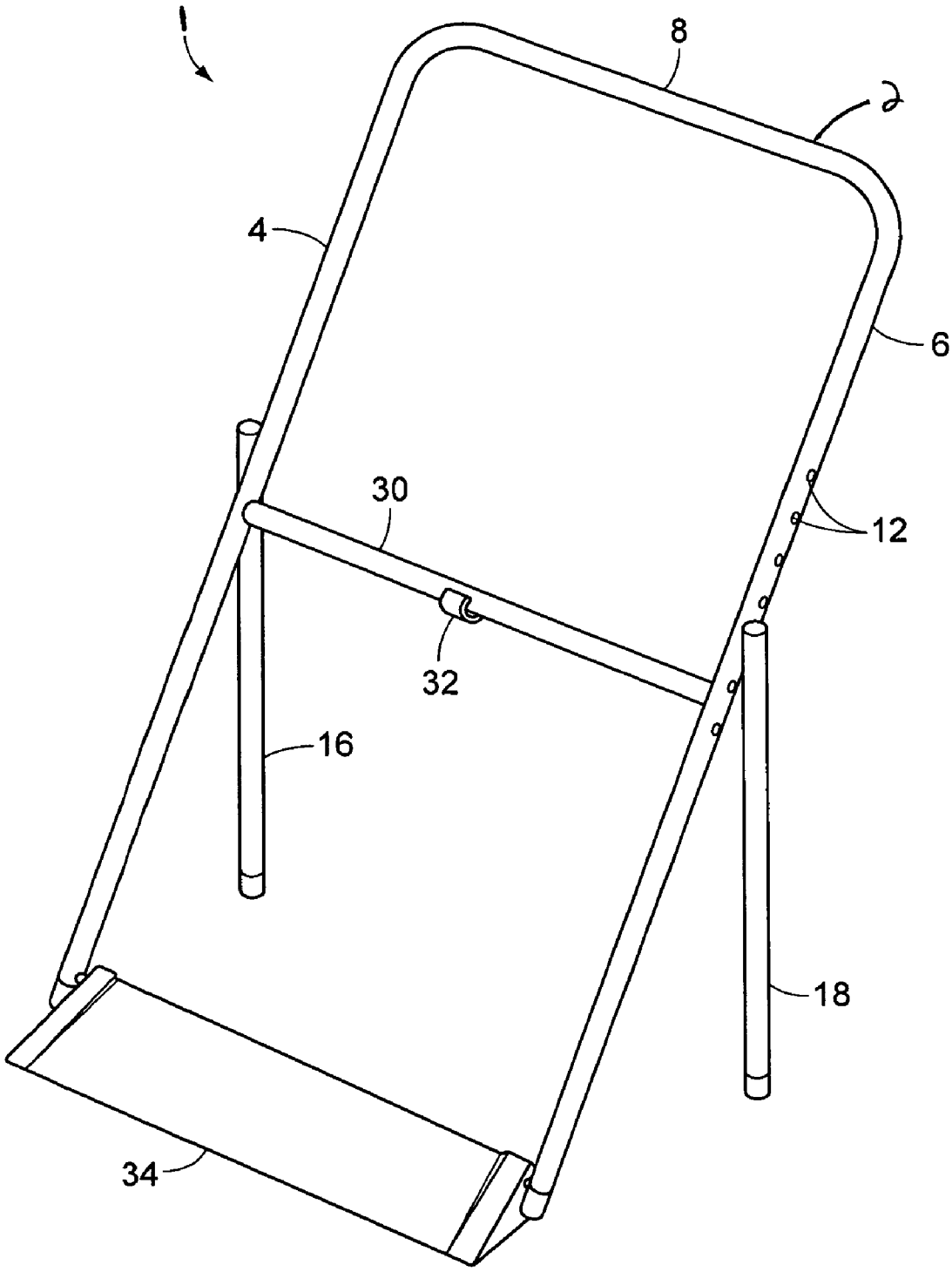
FIG. 1 shows a perspective view of the bag holder.

FIG. 1 shows a perspective view of the bag holder 2. Bag holder 2 has two side poles comprising a first side pole 4 and a second side pole 6, with each side pole having two ends, an upper end and a lower end. Bag holder 2 also has a handle bar 8 that has two ends, a first end and a second end. The first end of the handle bar 8 is attached to the upper end of the first side pole 4, while the second end of the handle bar 8 is attached to the upper end of the second side pole 6. Handle bar 8 can generally be used to carry around the bag holder 2.

Each of the side poles 4 and 6 has a plurality of holes 12 facing outward. To first side pole 4 is attached an adjustable arm 16, while to second side pole 6 is attached adjustable arm 18. Each adjustable arm has two ends, an upper end and a lower end. The upper end of the adjustable arm 16 is pivotally attached to a hole 12 located on the first side pole 4, while the upper end of the adjustable arm 18 is pivotally attached to a hole 12 located on the second side pole 6. Each of the adjustable arms are to be used in conjunction with the bag holder 2 so the bag holder 2 can be properly mounted on a ground surface.

Middle bar 30 has two ends, a first end and a second end. The first end of the middle bar 30 is attached to the first side pole 4 approximately halfway between the first end and the second end of the first side pole 4. The second end of the middle bar 30 is attached to the second side pole 6 approximately halfway between the first end and the second end of the second side pole 6. To middle bar 30 is attached a clip 32 that can be used to hold a garbage bag in an open position.

Bag holder 2 also has a dust pan 34 that has two ends, a first end and a second end. The first end of the dust pan 34 is attached to the lower end of the first side pole 4, while the second end of the dust pan 34 is attached to the lower end of the first side pole 6. Dust pan 34 acts as a small ramp to allow leaves 36 that are brushed toward the bag holder 2 to move up and over the dust pan 34 into an attached bag.

Figure 2:
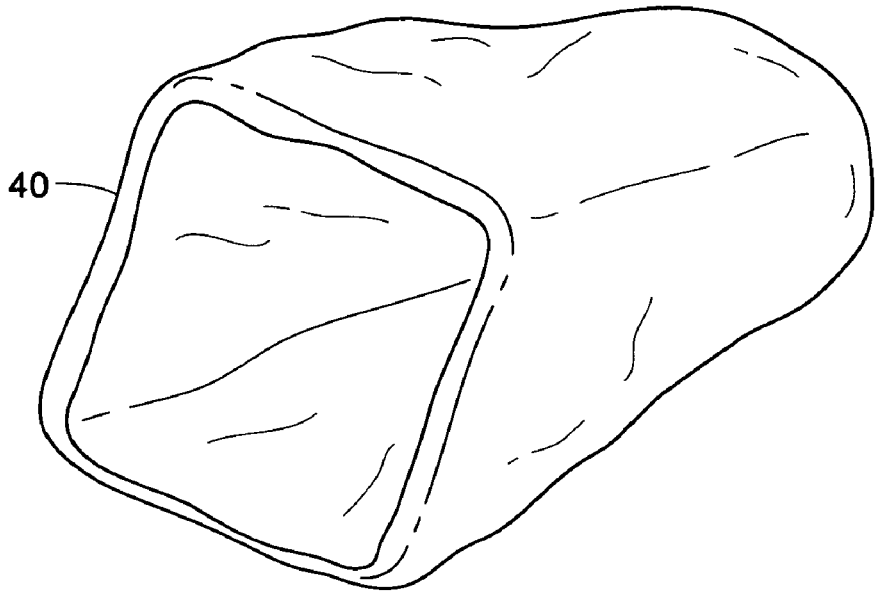
FIG. 2 shows a representative view of a bag used with the present invention.

FIG. 2 shows a representative view of a bag 40 used with the present invention. Bag 40 is used to gather a bunch of leaves 36 that may have fallen to a ground surface.

Figure 3:
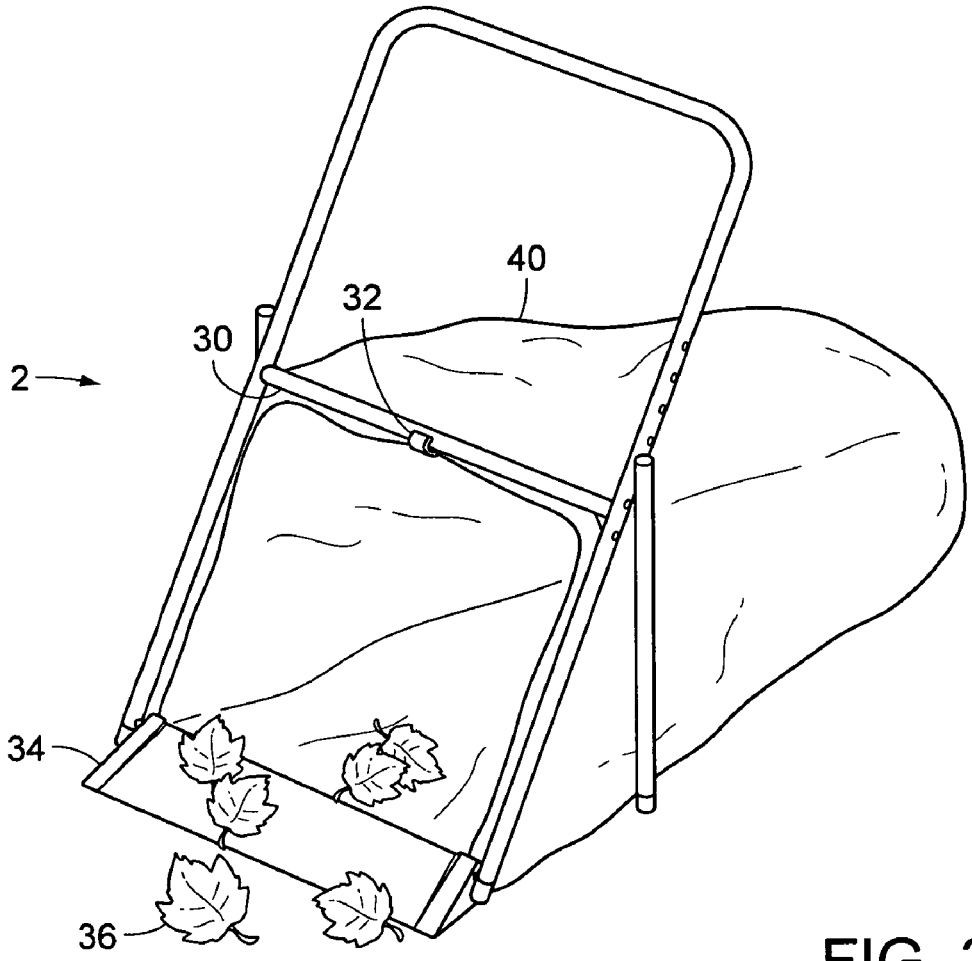
FIG. 3 shows a perspective view of the present invention as it would appear in use.

FIG. 3 shows a perspective view of the present invention as it would appear in use. The clip 32 on the middle bar 30 of bag holder 2 is shown holding up the bag 40 so that the leaves can easily be brushed or blown into the bag 40. The dust pan 34 acts as a small ramp to allow leaves 36 that are brushed toward the bag holder 2 to move up and over the dust pan 34 into an attached bag 40.

What I claim as my invention is:

1. An apparatus for facilitating trash removal comprising:

a bag holder having a first side pole and a second side pole, each side pole having an upper end and a lower end, a handle bar having a first end and a second end, the first end of the handle bar attached to the upper end of the first side pole, and the second end of the handle bar attached to the upper end of the second side pole, a first plurality of holes located on the first side pole, a second plurality of holes located on the second side pole, means for mounting the bag holder in an upright position, the means for mounting pivotally secured to the first side pole and the second side pole, a middle bar having a first end and a second end, the first end of the middle bar being attached to the first side pole approximately halfway between the first end and the second end of the first side pole, the second end of the middle bar being attached to the second side pole approximately halfway between the first end and the second end of the second side pole, a dust pan having a first end and a second end, the first end of the dust pan being attached to the lower end of the first side pole, the second end of the dust pan being attached to the lower end of the second side pole, a trash bag, means for attaching the trash bag to the middle bar, wherein the means for attaching the trash bag to the middle bar further comprises a clip, the clip being attached to the middle bar, wherein debris and trash can be swept up the ramp into the trash bag as needed.

2. An apparatus for facilitating trash removal according to claim 1 wherein the means for mounting the bag holder in an upright position further comprises a pair of adjustable arms comprising a first adjustable arm and a second adjustable arm, each adjustable arm having an upper end and a lower end, wherein the upper end of the first adjustable arm is pivotally mounted to a hole of the first plurality of holes, and further wherein the upper end of the second adjustable arm is pivotally mounted to a hole of the second plurality of holes.

3. An apparatus for facilitating trash removal comprising:

a bag holder having a first side pole and a second side pole, each side pole having an upper end and a lower end, a handle bar having a first end and a second end, the first end of the handle bar attached to the upper end of the first side pole, and the second end of the handle bar attached to the upper end of the second side pole, a first plurality of holes located on the first side pole, a second plurality of holes located on the second side pole, means for mounting the bag holder in an upright position, the means for mounting releasably secured to the first side pole and the second side pole, the means for mounting the bag holder in an upright position further including a pair of adjustable arms comprising a first adjustable arm and a second adjustable arm, each adjustable arm having an upper end and a lower end, wherein the upper end of the first adjustable arm is pivotally mounted to a hole of the first plurality of holes, and further wherein the upper end of the second adjustable arm is pivotally mounted to a hole of the second plurality of holes, a middle bar having a first end and a second end, the first end of the middle bar being attached to the first side pole approximately halfway between the first end and the second end of the first side pole, the second end of the middle bar being attached to the second side pole approximately halfway between the first end and the second end of the second side pole, a dust pan having a first end and a second end, the first end of the dust pan being attached to the lower end of the first side pole, the second end of the dust pan being attached to the lower end of the second side pole, a trash bag, means for attaching the trash bag to the middle bar, wherein debris and trash can be swept up the ramp into the trash bag as needed.

4. An apparatus for facilitating trash removal according to claim 3 wherein the means for attaching the trash bag to the middle bar further comprises a clip, the clip being attached to the middle bar.

* * * * *